US011661783B1

(12) United States Patent
Wu et al.

(10) Patent No.: US 11,661,783 B1
(45) Date of Patent: May 30, 2023

(54) ELECTRIC SUPPORT ROD

(71) Applicants: HSIN CHONG MACHINERY WORKS CO. LTD., Taoyuan (TW); FUZHOU MINGFANG AUTOMOBILE PARTS INDUSTRY CO., LTD., Fuzhou (CN)

(72) Inventors: Chi-Wang Wu, Taoyuan (TW); Feng-Lin Yang, Taoyuan (TW); Jeffrey Chung-Chiang Hsi, Taoyuan (TW)

(73) Assignees: HSIN CHONG MACHINERY WORKS CO. LTD., Taoyuan (TW); FUZHOU MINGFANG AUTOMOBILE PARTS INDUSTRY CO., LTD., Fuzhou (CN)

( * ) Notice: Subject to any disclaimer, the term of this patent is extended or adjusted under 35 U.S.C. 154(b) by 0 days.

(21) Appl. No.: 17/684,406

(22) Filed: Mar. 1, 2022

(51) Int. Cl.
*E05F 15/622* (2015.01)

(52) U.S. Cl.
CPC ..... *E05F 15/622* (2015.01); *E05Y 2201/696* (2013.01)

(58) Field of Classification Search
CPC ..... E05F 15/622; E05F 15/63; E05F 1/1091; E05F 1/1058; E05F 11/34; E05Y 2201/696; E05Y 2900/544; E05Y 2900/546; E05Y 2900/548
See application file for complete search history.

(56) References Cited

U.S. PATENT DOCUMENTS 6,516,567 B1 * 2/2003 Stone ..... E05F 15/622 49/343
8,375,814 B2 * 2/2013 Hillen ..... E05F 15/622 74/89.38

(Continued)

FOREIGN PATENT DOCUMENTS

CN 215056470 U 12/2021
CN 216866386 U * 7/2022

(Continued)

OTHER PUBLICATIONS

Office Action dated Aug. 2, 2022 of the corresponding Taiwan patent application No. 111100731.

*Primary Examiner* — Justin B Rephann
(74) *Attorney, Agent, or Firm* — Chun-Ming Shih; HDLS IPR Services

(57) ABSTRACT

This disclosure is directed to an electric support rod having a driving assembly, an actuating assembly, and a bearing. The driving assembly has a first outer tube and a driving unit in the first outer tube. An internal thread is configured in the first outer tube. The actuating assembly has a second outer tube and a transmission screw rod in the second outer tube. Multiple elastic arms axially are extended from the second outer tube and arranged spacedly around the transmission screw rod. Each elastic arm has an outer thread structure and a hook portion. The second outer tube is inserted in the first outer tube, the internal thread is screwed with the outer thread structure. One end of the transmission screw rod protrudes from the second outer tube to engage the driving (Continued)

unit. The bearing sheathes the transmission screw rod and the hook portion latches the bearing.

10 Claims, 5 Drawing Sheets

(56) References Cited

U.S. PATENT DOCUMENTS

| | | | | |
|---|---|---|---|---|
| 8,601,891 | B2 * | 12/2013 | Boehen | F16H 25/2015 74/89.37 |
| 10,100,568 | B2 * | 10/2018 | Scheuring | E05F 15/622 |
| 10,767,412 | B2 * | 9/2020 | Scheuring | E05F 15/622 |
| 11,428,037 | B2 * | 8/2022 | Kummer | B60J 5/106 |
| 2018/0283076 | A1 * | 10/2018 | Gorosin | F16H 25/20 |
| 2021/0054889 | A1 * | 2/2021 | Bals | E05F 3/16 |

FOREIGN PATENT DOCUMENTS

| | | | |
|---|---|---|---|
| TW | 267389 | U | 1/1996 |
| TW | M629374 | U | 7/2022 |

* cited by examiner

ELECTRIC SUPPORT ROD

BACKGROUND OF THE DISCLOSURE

Technical Field

This disclosure is directed to an electric support rod of a tailgate of a car and in particular to a two-segment electric support rod which is easy to be assembled.

Description of Related Art

A related-art electric tailgate of a car is supported and driven by electric support rods arranged at two sides of a door frame. The electric support rod has an electric motor and a telescopic pole linked with the electric motor, the telescopic pole can be driven to telescope by controlling the electric motor to rotate so as to open or close the tailgate.

In general, the electric support rod has an outer tube, and the telescopic pole and the electric motor are inserted in the outer tube. The telescopic pole has a screw rod connected to the electric motor, and a bearing for fixing the screw rod is arranged between the screw rod and the outer tube. An inner edge of the bearing needs to be tightly fit with the screw rod and an outer edge of the bearing needs to be tightly fit with an inner wall of the outer tube. Furthermore, the outer tube is relatively long, and the bearing is therefore difficult to be assembled.

In view of the above drawbacks, the inventor proposes this disclosure based on his expert knowledge and elaborate researches in order to solve the problems of related art.

SUMMARY OF THE DISCLOSURE

This disclosure is directed to a two-segment electric support rod which is easy to be assembled.

This disclosure is directed to an electric support rod having a driving assembly, an actuating assembly, and a bearing. The driving assembly has a first outer tube and a driving unit accommodated in the first outer tube, the first outer tube has a first engaging end and an internal thread arranged on an inner surface of the first engaging end. The actuating assembly has a second outer tube and a transmission screw rod inserted in the second outer tube, the second outer tube has a second engaging end and a plurality of elastic arms. The elastic arms are axially extended from the second engaging end and disposed spacedly around the transmission screw rod. Each elastic arm has an internal surface facing the transmission screw rod and an external surface opposite to the transmission screw rod. An outer thread structure is arranged on the external surface, a hook portion is disposed protrusively from the internal surface. The second engaging end is inserted in the first engaging end, the internal thread is screwed with the outer thread structure, and one end of the transmission screw rod protrudes from the second outer tube to be engaged the driving unit. The bearing is adapted to sheathe the transmission screw rod, and the hook portion latches an outer edge of the bearing.

According to the electric support rod of this disclosure, the outer edge of the bearing is attached on the internal surface of the elastic arm.

According to the electric support rod of this disclosure, the actuating assembly further has a telescopic set inserted in the second outer tube and adapted to sheathe the transmission screw rod, and the telescopic set has a nut screwed with the transmission screw rod.

According to the electric support rod of this disclosure, the transmission screw rod has a transmission thread, the transmission screw rod has a tenon laterally inserted in the transmission screw rod, and the bearing is clamped between one end of the transmission thread and the tenon.

According to the electric support rod of this disclosure, each outer thread structure has a plurality of thread segments disposed parallelly, and the thread segments of the outer thread structure are configured with the internal thread in the same helix line.

According to the electric support rod of this disclosure, an outer surface of the second outer tube has an external thread extended from any one of the outer thread structures, and the external thread and the thread segments of the outer thread structures are configured with the internal thread in the same helix line. The outer surface of the second outer tube has a connecting surface, the connecting surface is attached on the inner surface of the first outer tube. The external thread is disposed between the connecting surface and the outer thread structure and is screwed with the internal thread. The connecting surface is a curved annular surface surrounding a lateral side of the second outer tube.

Accordingly, the driving unit of the electric support rod of this disclosure may be preassembled to the first outer tube. The telescopic set, the transmission screw rod and the bearing may be preassembled to the second outer tube, and then the first outer tube may be engaged with the second outer tube so that the transmission screw rod is power connected with the driving unit and the bearing is positioned.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
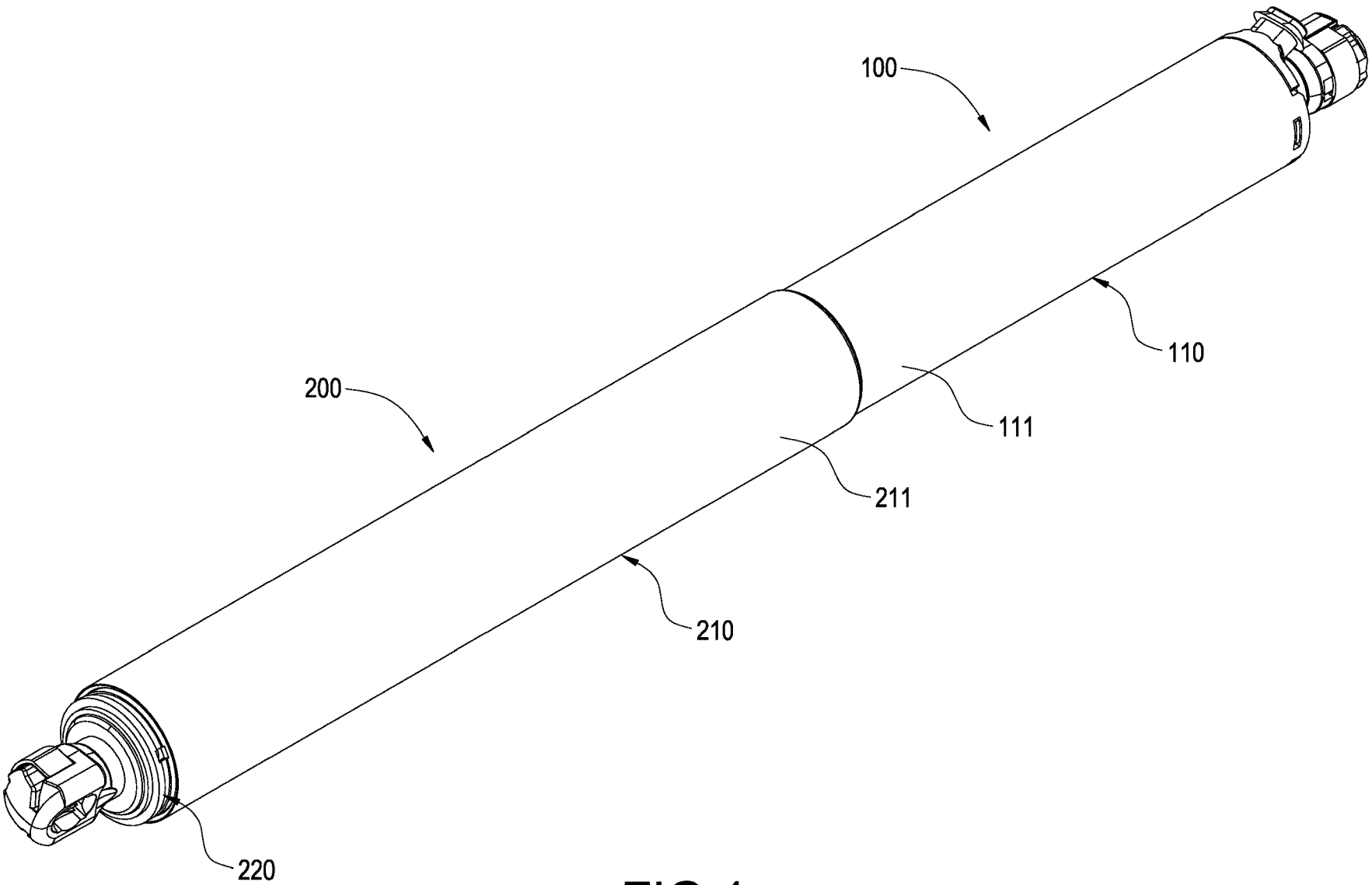
FIG. 1 is a perspective view showing an electric support rod according to an embodiment of this disclosure.
Figure 2:
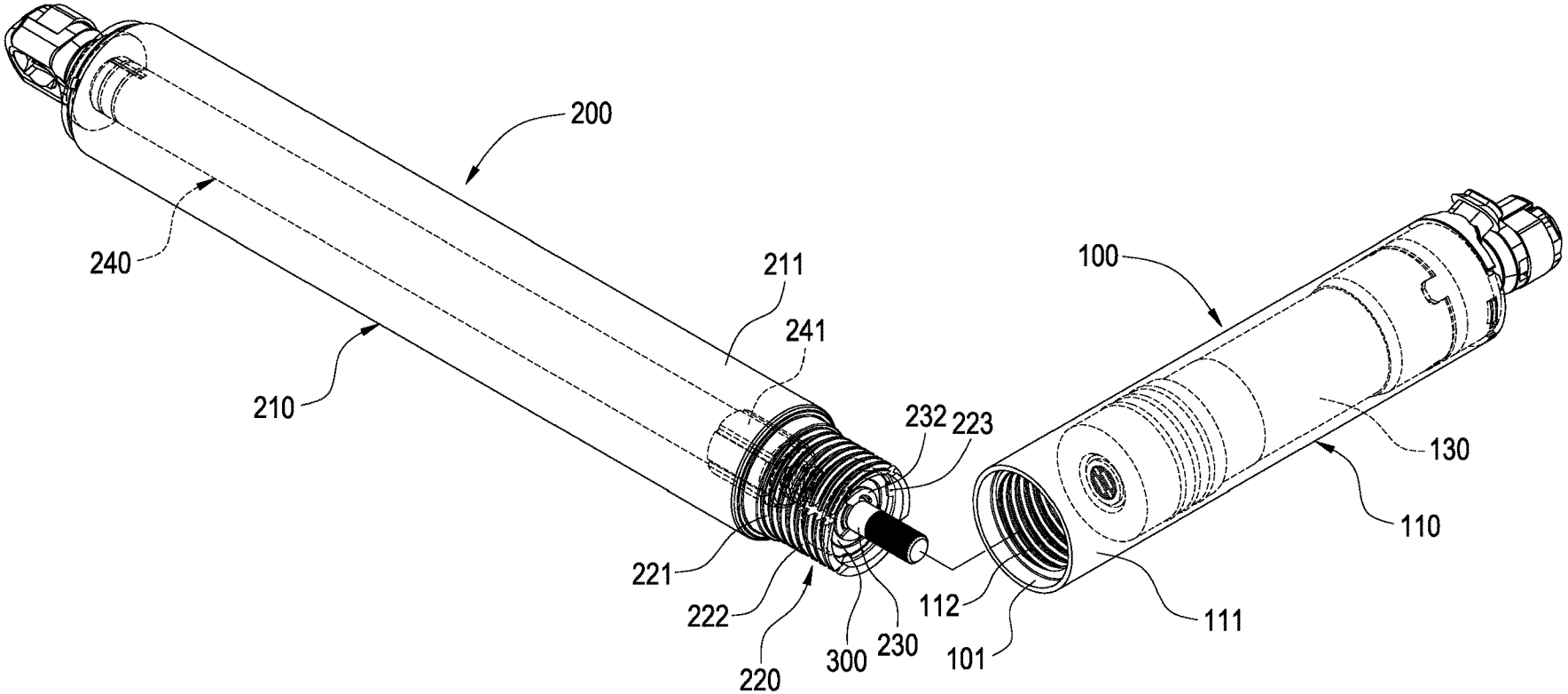
FIG. 2 is an exploded view of the electric support rod according to the aforementioned embodiment of this disclosure.
Figure 3:
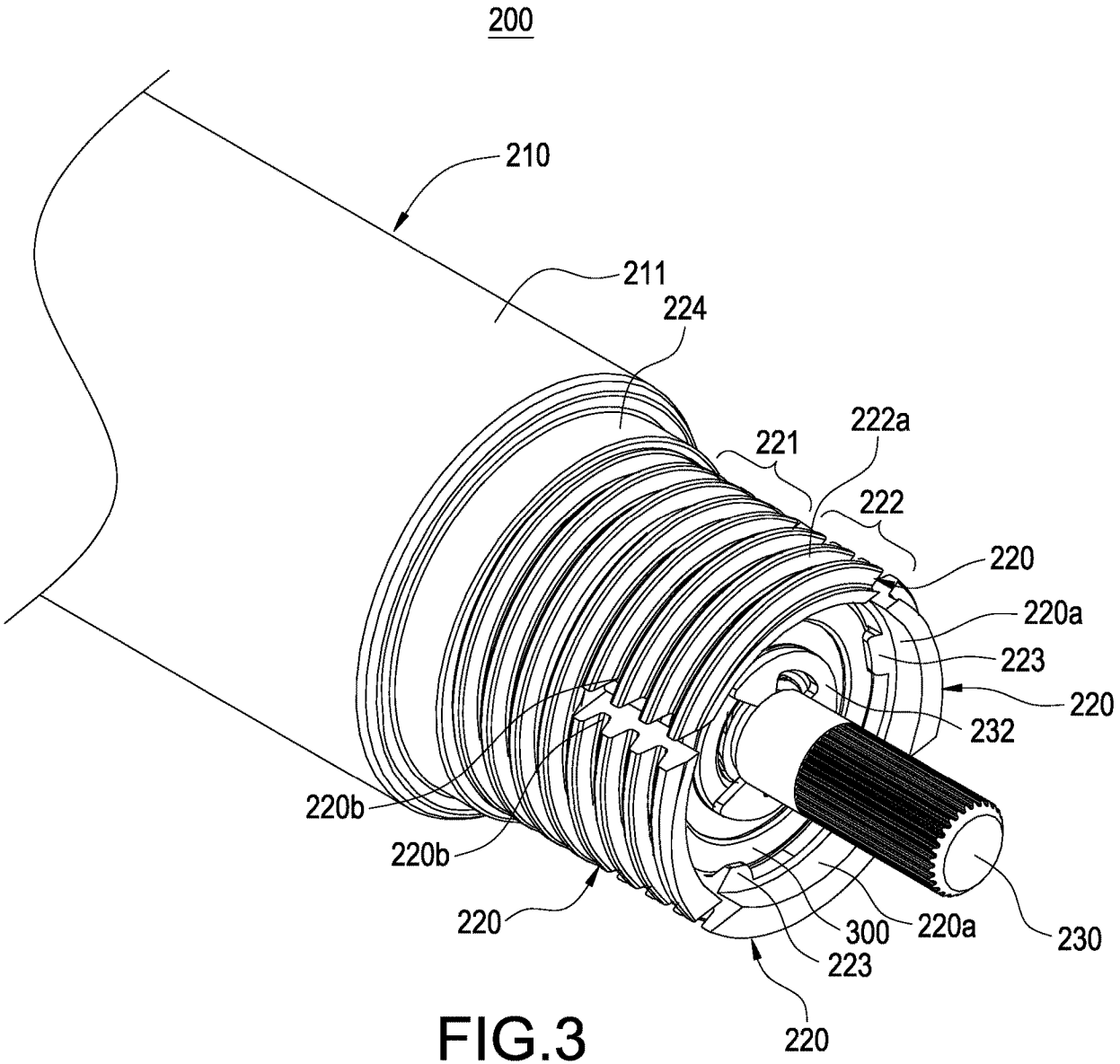
FIG. 3 is a perspective view showing an actuating assembly of the electric support rod according to an embodiment of this disclosure.
Figure 4:
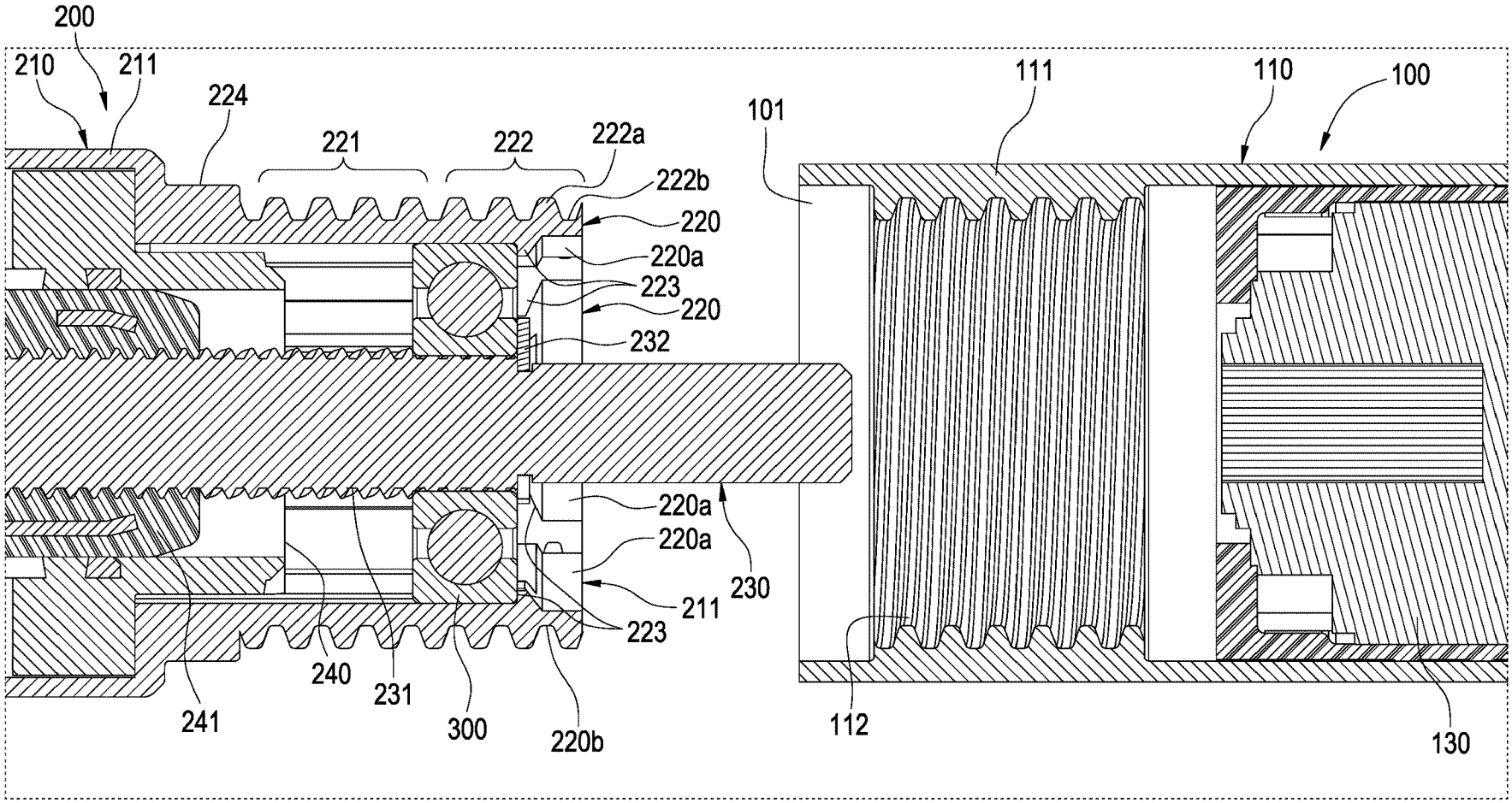
FIG. 4 is a cross-sectional view of the electric support rod along a longitudinal direction according to the aforementioned embodiment of this disclosure showing that the driving assembly is separated from the actuating assembly the electric support rod.
Figure 5:
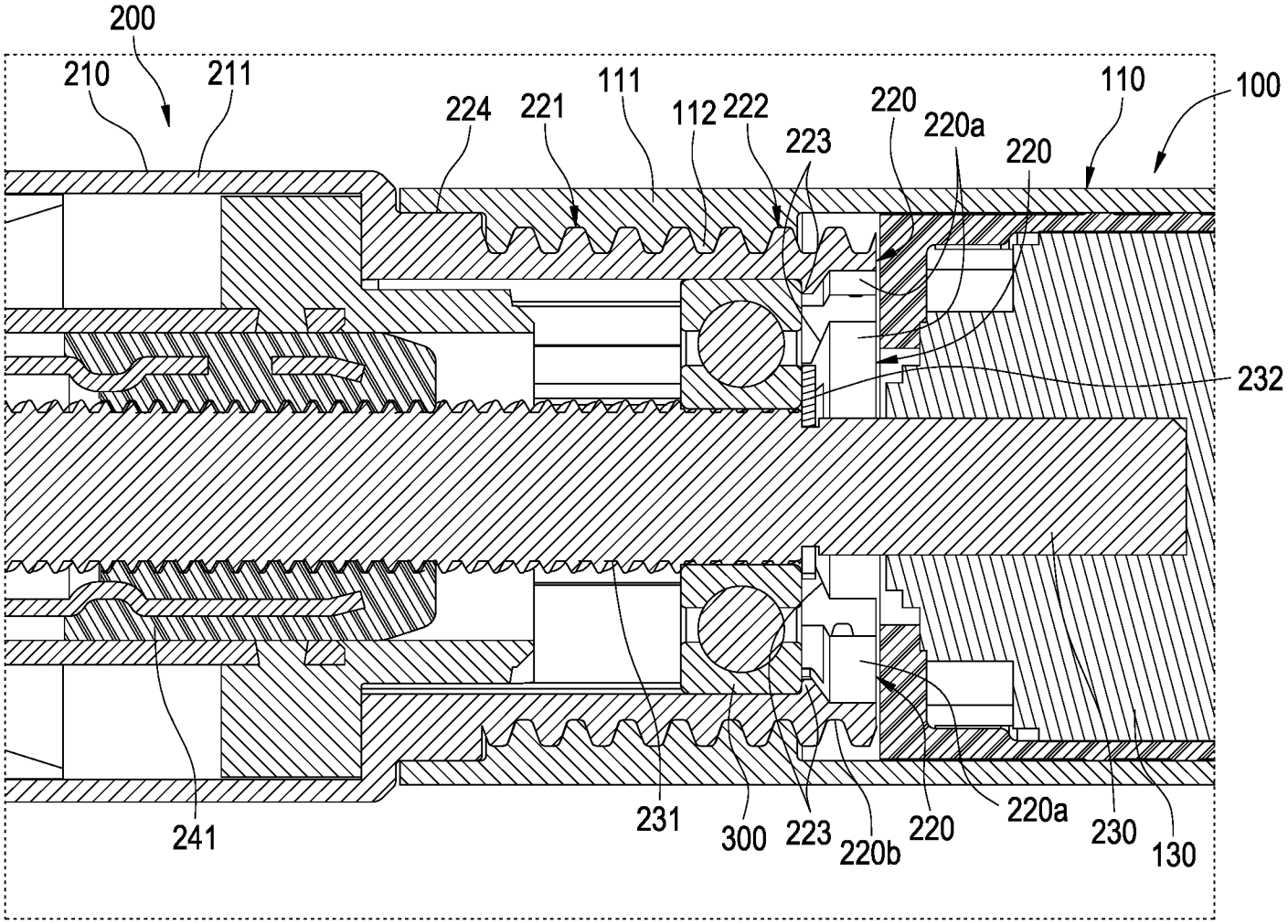
FIG. 5 is a cross-sectional view of the electric support rod along a longitudinal direction according to the aforementioned embodiment of this disclosure.

According to an embodiment of this disclosure shown in FIGS. 1 to 5, this disclosure is directed to an electric support rod having a driving assembly 100, an actuating assembly 200 and a bearing 300.

According to this embodiment, the driving assembly 100 has a first outer tube 110 and a driving unit 130 accommodated in the first outer tube 110. The first outer tube 110 has a first engaging end 111, the first engaging end 111 has an opening 101, and an internal thread 112 is arranged on an inner surface of the first engaging end 111. According to this embodiment, the driving unit 130 at least has a motor.

The actuating assembly 200 has a second outer tube 210 and a transmission screw rod 230 inserted in the second outer tube 210. The second outer tube 210 has a second engaging end 211, and a plurality of elastic arms 220. The elastic arms are extended from the second engaging end 211 along an axial direction of the second outer tube 210 and disposed around the transmission screw rod 230 at intervals. Each elastic arm 220 has an internal surface 220*a* facing the transmission screw rod 230 and an external surface 220*b* opposite to the transmission screw rod 230, an outer thread structure 222 is arranged on each external surface 220*b*, a hook portion 223 is disposed protrusively on each internal surface 220*a*. Each outer thread structure 222 has a plurality of thread segments 222*a* disposed parallelly, each thread segment 222*a* is extended across the elastic arm 220 where the thread segment 222*a* is located, and the thread segments 222*a* are configured with the internal thread 112 in the same helix line.

An outer surface of the second outer tube 210 has a connecting surface 224 and an external thread 221, the connecting surface 224 is a curved annular surface surrounding a lateral side of the second outer tube 210, and the external thread 221 is configured between the connecting surface 224 and the outer thread structures 222. The external thread 221 extended from any one of the outer thread structures 222, and the external thread 221 and the thread segments 222*a* of the outer thread structures 222 configured with the internal thread 112 in the same helix line.

The transmission screw rod 230 has a transmission thread 231, the transmission screw rod 230 is provided with a tenon 232 which is inserted into the transmission screw rod 230 along a lateral direction of the transmission screw rod 230, and the bearing 300 is clamped between one end of the transmission thread 231 and the tenon 232. According to this embodiment, the tenon 232 is a C-clip, but scope of this disclosure should not be limited to the aforementioned embodiment. For example, the tenon 232 may be a pin inserted into the transmission screw rod 230.

The actuating assembly 200 further has a telescopic set 240 inserted in the second outer tube 210 and adapted to sheathe the transmission screw rod 230. The telescopic set 240 has a plurality of tubes movably sheathed with one another, thereby telescoping for varying a length of the telescopic set 240. Moreover, the telescopic set 240 has a nut 241 screwed with the transmission screw rod 230, the nut 241 is connected to one of the tubes, the nut 241 is moved along a longitudinal direction of the transmission screw rod 230 when the transmission screw rod 230 is rotated, so as to drive the telescopic set 240 to telescope.

According to this embodiment, the bearing 300 is of a ring shape, the bearing 300 sheathes the transmission screw rod 230 and an inner edge thereof is tightly fit with the transmission screw rod 230. An outer diameter of the bearing 300 is fit with a ring enclosed by the internal surfaces 220*a* of the elastic arm 220. The bearing 300 is put into the second outer tube 210 along a longitudinal direction of the second outer tube 210, the bearing 300 presses the hook portions 223 when moves into the second outer tube 210 so as to outward push the elastic arms 220. The bearing 300 passes the hook portions 223 and then the elastic arms 220 return inward so that an outer edge of the bearing 300 is attached with the internal surfaces 220*a* of the elastic arms 220, and the hook portions 223 latch the outer edge of the bearing 300 to fix the bearing 300 in the second outer tube 210.

The second engaging end 211 is inserted into the first engaging end 111 through the opening 101, the internal thread 112 is screwed with the outer thread structures 222, and the external thread 221 is screwed with the internal thread 112, so that the first outer tube 110 is connected with the second outer tube 210. One end of the transmission screw rod 230 protrudes from the second outer tube 210 to be engaged the driving unit 130, and the transmission screw rod 230 and the motor of the driving unit 130 are co-axially disposed. The first outer tube 110 and the second outer tube 210 may be further welded to fix with each other. According to this embodiment, the connecting surface 224 is attached with the inner surface of the first outer tube 110, namely attached to a region between the opening 101 and the internal thread 112, and the connecting surface 224 may be fixed with the inner surface of the first outer tube 110 via laser welding, high frequency bonding, binder, etc.

Accordingly, the driving unit 130 of the electric support rod of this disclosure may be pre-assembled to the first outer tube 110, the telescopic set 240, the transmission screw rod 230 and the bearing 300 may be pre-assembled to the second outer tube 210, and then the first outer tube 110 may be engaged with the second outer tube 210 so as to link the transmission screw rod 230 with the driving unit 130. The second outer tube 210 has elastic arms 220, the elastic arm 220 has the hook portion 223 and the outer thread structure 222 respectively disposed at inside and outside thereof, the bearing 300 may be fixed by the hook portion 223 when move into the second outer tube 210 so as to avoid loosening for a convenience of engaging the second outer tube 210 with the first outer tube 110. Moreover, the second outer tube 210 is engaged with the first outer tube 110, and then the elastic arm 220 is positioned by the inner surface of the first outer tube 110 so as to tightly fit the outer edge of the bearing.

While this disclosure has been described by means of specific embodiments, numerous modifications and variations could be made thereto by those skilled in the art without departing from the scope and spirit of this disclosure set forth in the claims.

What is claimed is:

1. An electric support rod, comprising:

a driving assembly, comprising a first outer tube and a driving unit accommodated in the first outer tube, the first outer tube comprising a first engaging end and an internal thread arranged on an inner surface of the first engaging end;

an actuating assembly, comprising a second outer tube and a transmission screw rod inserted in the second outer tube, the second outer tube comprising a second engaging end and a plurality of elastic arms, the elastic arms axially extended from the second engaging end and disposed spacedly around the transmission screw rod, each elastic arm comprising an internal surface facing the transmission screw rod and an external surface opposite to the transmission screw rod, an outer thread structure arranged on the external surface, a hook portion disposed protrusively on the internal surface, the second engaging end inserted in the first engaging end, the internal thread screwed with the outer thread structure, and one end of the transmission screw rod protruding from the second outer tube to be engaged to the driving unit; and a bearing, adapted to sheathe the transmission screw rod, and the hook portions latched an outer edge of the bearing.

2. The electric support rod according to claim 1, wherein the outer edge of the bearing is attached on the internal surface of each elastic arm.

3. The electric support rod according to claim 1, wherein the actuating assembly further comprises a telescopic set inserted in the second outer tube and adapted to sheathe the transmission screw rod, and the telescopic set comprises a nut screwed with the transmission screw rod.

4. The electric support rod according to claim 1, wherein the transmission screw rod comprises a transmission thread, the transmission screw rod comprises a tenon laterally inserted in the transmission screw rod, and the bearing is clamped between one end of the transmission thread and the tenon.

5. The electric support rod according to claim 1, wherein the outer thread structure comprises a plurality of thread segments disposed parallelly, and the thread segments of the outer thread structure are configured with the internal thread in a same helix line.

6. The electric support rod according to claim 1, wherein the second outer tube comprises an external thread disposed on an outer surface thereof and continuing with the outer thread structure, the external thread and the thread segments of the outer thread structure are configured with the internal thread in a same helix line.

7. The electric support rod according to claim 6, wherein the second outer tube comprises a connecting surface disposed on the outer surface thereof, the connecting surface is attached on the inner surface of the first outer tube, and the external thread is disposed between the connecting surface and the outer thread structure and is screwed with the internal thread.

8. The electric support rod according to claim 7, wherein the connecting surface is a curved annular surface surrounding a lateral side of the second outer tube.

9. The electric support rod according to claim 1, wherein the second outer tube comprises a connecting surface disposed on the outer surface thereof, and the connecting surface is attached on the inner surface of the first outer tube.

10. The electric support rod according to claim 9, wherein the connecting surface is a curved annular surface surrounding a lateral side of the second outer tube.

* * * * *